US006596414B1

(12) United States Patent
Ishizuka et al.

(10) Patent No.: US 6,596,414 B1
(45) Date of Patent: Jul. 22, 2003

(54) PHOSPHATE-TREATED GALVANIZED STEEL SHEET EXCELLENT IN CORROSION RESISTANCE AND PAINTABILITY

(75) Inventors: Kiyokazu Ishizuka, Himeji (JP); Hidetoshi Shindo, Himeji (JP); Kimitaka Hayashi, Himeji (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/959,877

(22) PCT Filed: May 23, 2000

(86) PCT No.: PCT/JP00/03291

§ 371 (c)(1),
(2), (4) Date: Nov. 9, 2001

(87) PCT Pub. No.: WO00/73535

PCT Pub. Date: Dec. 7, 2000

(30) Foreign Application Priority Data

May 27, 1999 (JP) ..... 11-148759

(51) Int. Cl.[7] ..... B32B 15/00
(52) U.S. Cl. ..... 428/659; 428/469; 428/472.3
(58) Field of Search ..... 428/659, 469, 428/472.3; 148/253, 261, 262, 273

(56) References Cited

U.S. PATENT DOCUMENTS 4,264,378 A * 4/1981 Oppen et al. ..... 148/261
6,322,906 B1 * 11/2001 Nakakoji et al. ..... 428/659

FOREIGN PATENT DOCUMENTS

| | | |
|---|---|---|
| EP | 15020 | 9/1980 |
| EP | 0653502 A2 * | 5/1995 |
| JP | 62-33780 | 2/1987 |
| JP | 9-49086 | 2/1997 |

* cited by examiner

*Primary Examiner*—Robert R. Koehler
(74) *Attorney, Agent, or Firm*—Wenderoth, Lind & Ponack, L.L.P.

(57) ABSTRACT

The present invention provides phosphate-treated galvanized steel sheet excellent in corrosion resistance and paintability, including:

a phosphate-treated galvanized steel sheet excellent in corrosion resistance and paintability, comprising a phosphate film in an amount of at least 0.5 g/m$^2$, containing at least 2 wt. % of Mg, and at least 0.5 wt. % in total of Ni and/or Mn, with at least 4 wt. % in total of Mg and Ni and/or Mn, formed on a zinc or zinc alloy plated steel sheet; and a phosphate-treated galvanized steel sheet excellent in corrosion resistance and paintability, comprising a phosphate film in an amount of at least 0.3 g/m$^2$, preferably at least 1 g/m$^2$, containing at least 2 wt. % of Mg, and at least 0.5 wt. % in total of Ni and/or Mn, with at least 5 wt. % in total of Mg and Ni and/or Mn, formed on a zinc or zinc alloy plated steel sheet.

2 Claims, No Drawings

PHOSPHATE-TREATED GALVANIZED STEEL SHEET EXCELLENT IN CORROSION RESISTANCE AND PAINTABILITY

BACKGROUND OF THE INVENTION

1. Field of the Invention

The present invention relates to a phosphate-treated galvanized steel sheet excellent in corrosion resistance and paintability for use in such applications as automobiles, home electric appliances and building materials.

2. Description of the Related Art

It has been the most common conventional practice to subject galvanized steel sheets for use in applications such as automobiles, home electric appliances and building materials to a phosphate treatment, a chromate treatment, and further, an organic coating treatment with a view to improving added values such as corrosion resistance and paintability of the galvanized steel sheets. However, the recent tendencies have been that the chromate-treated steel sheet, in particular, which may contain hexavalent chromium is avoided from environment problems, and there has been an increasing demand for phosphate treatment of the galvanized steel sheets.

With the conventional phosphate treatment of a galvanized steel sheet, however, sufficient corrosion resistance or paintability is not always achieved, and therefore various methods for the improvements have been proposed. For example, Japanese Patent Publication No. 60-34912 discloses a method in which after a phosphate film is formed, the film is treated with an inhibitor. Japanese Laid-Open Patent Applications Nos. 60-50175 and 8-13154 disclose methods of achieving coexistence of Ni, Mn and the like in a phosphate film.

The aforementioned methods, while giving certain effects, are not sufficient to meet with the recent severer requirements for corrosion resistance, and provides almost no improving effect of bare corrosion resistance in particular.

Japanese Laid-Open Patent Applications Nos. 1-312081 and 3-107469 disclose zinc phosphate films containing Mg. In these cases also, the corrosion resistance improving effect is not sufficient, with an insufficient paintability. Further, Japanese Laid-Open Patent Application No. 9-49086 discloses a method of forming a zinc phosphate film containing Ni and Mg, still suffering from the problem of insufficient corrosion resistance.

DESCRIPTION OF THE INVENTION

The present invention has an object to solve these problems and provide a phosphate-treated galvanized steel sheet excellent in corrosion resistance and paintability.

For phosphate-treatment of a galvanized steel sheet, the present inventors have made various trials to cause Mg ion and Ni ion to be coexistent in large quantities in a treatment bath and to form a high-phosphate film having high contents of Mg and Ni which could not be achieved by the conventional art. As a result, it has been found that corrosion resistance and paintability can be improved by increasing the contents of both Mg and Ni in the phosphate film. It has been further found that a phosphate film having still higher Mg and Ni contents is achieved by coating an aqueous phosphate solution containing Mg and/or Ni, after the formation of the phosphate film containing Mg and Ni, and drying the resultant coated sheet without rinsing with water.

These findings have led to a conclusion that, by maintaining the Mg and Ni contents in the resultant phosphate film within a specific range respectively, it is possible to obtain very good corrosion resistance and paintability so far unknown. It has been still further found that the same effect can be achieved by Mn in place of Ni.

The present invention has been completed on the basis of the aforementioned findings and the gist of the present invention is to provide a phosphate-treated galvanized steel sheet excellent in corrosion resistance and paintability, comprising a phosphate film in an amount of at least 0.5 g/m$^2$, containing at least 2 wt. % of Mg and at least 0.5 wt. % of Ni and/or Mn, with Mg and Ni and/or Mn being in total, formed on the surface of a steel sheet coated with zinc or a zinc alloy; and further provide a phosphate-treated galvanized steel sheet excellent in corrosion resistance and paintability, comprising a phosphate film in an amount of at least 0.3 g/m$^2$, preferably at least 1 g/m$^2$, containing at least 2 wt. % of Mg, at least 0.5 wt. % of Ni and/or Mn, with Mg and Ni and/or Mn being in an amount of at least 5 wt. % in total, formed on the surface of a steel sheet plated with zinc or a zinc alloy.

DESCRIPTION OF PREFERRED EMBODIMENTS

There is no particular limitation regarding the galvanized steel sheet used in the invention, and the invention is applicable to both pure zinc coated and zinc alloy coated steel sheet. Any zinc and zinc alloy coating method including electro-galvanizing, hot-dip galvanizing and vapor deposition may be applicable.

According to the present invention, the phosphate film formed on the galvanized steel sheet normally contains Zn dissolved from the zinc coating or coming from the phosphate treatment bath, but it is essential that the film contains Mg and Ni and/or Mn. The required ratios of these metal contents to the weight of the phosphate film as a whole are at least 2 wt. % for Mg, at least 0.5 wt. % for Ni and/or Mn, and at least 4 wt. % for the total of Mg and Ni and/or Mn. Any of these metal contents below the lower limits results in remarkable deterioration of corrosion resistance and paintability. Mg, Ni and/or Mn should preferably be at least 5 wt. % in total.

There is no particular limitation for the upper limit of the contents of the above metals. However, the content of Mg and Ni singly or in combination is limited up to about 10 wt. %, and Mg and Mn and/or Ni in total is limited up to about 15 wt. %. It is technically difficult to maintain their contents over these upper limits.

The phosphate film containing at least 4 wt. % of Mg and Ni and/or Mn in total must be present in a weight of at least 0.5 g/m$^2$, below which no satisfactory corrosion resistance can be obtained. Also the phosphate film containing at least 5 wt. % of Mg and Ni and/or Mn in total must have a weight of at least 0.3 g/m$^2$, below which no sufficient corrosion resistance can be obtained, and which should more preferably be at least 1 g/m$^2$. Although there is no particular limitation on the upper limit, it should preferably be in general up to about 2.5 g/m2 when taking weldability into consideration.

Since Ni and Mn produce the same effects, the following description will cover only the case where Ni is used without using Mn.

The phosphate film containing Mg and Ni according to the invention can be obtained by the treatment using a phosphate bath containing Mg ion and Ni ion. Prior to such a treatment, it is desirable to perform a known pretreatment such as a titanium colloidal treatment or a brushing treatment. An example of the phosphate treatment bath may be illustrated by a bath prepared by adding Mg ion and Ni ion to a treatment bath containing Zn ion, phosphate ion, fluoride, an oxidizing agent (such as a nitrate, a nitrite or a chlorate). In this case, the concentration (weight percentage) of the metal ions relative to one Zn ion should be preferably about 10 to 50 for Mg ion, and about 1 to 10 for Ni ion. By using such a treatment bath, it is possible to form the phosphate film on the galvanized steel sheet by a spraying or dipping method, for example. However, by using such a method, if Mg and Ni are to coexist, their weight percentage in total in the resultant film is technically limited up to about 5% maximum. Trying to add them in a higher percentage is not only difficult, but also tends to cause defective precipitation of the film or production of much sludge.

In order to achieve coexistence of Mg and Ni in larger amounts, it is desirable to apply first a phosphate treatment using the bath containing Mg and Ni as described above, or a usual phosphate treatment using a bath not containing Mg or Ni, and then, to coat the thus treated sheet with an aqueous phosphate solution containing Mg and/or Ni, and drying the thus coated sheet without water rinsing to a sheet temperature of 90 to 150° C. without water rinsing, thereby forming a composite phosphate film. As the aqueous solution to be coated, an aqueous solution of a primary phosphate of the metals (known also as dihydrogen phosphate salt or biphosphate salt) is preferable, and as the coating method, a roll-coating method is preferable. The coating may be applied to the both surfaces, or only to one surface of the sheet. Particularly for an automobile sheet, for example, it is also appropriate to coat only the surface of the sheet which, when used in an automobile, forms the inner surface required to have a high corrosion resistance.

When the above aqueous phosphate solution is coated, the weight of the phosphate film according to the present invention is the total weight of the primary phosphate treatment film plus the phosphate film formed by the aqueous phosphate solution. And the contents of Mg and Ni in the film are the total contents of Mg and Ni in both the primary phosphate treatment film and the subsequently coated phosphate film formed by the phosphate solution are expressed as percents of the total weight of both films and when the total contents of Mg and Ni and the total weight of both films are within the specified ranges according to the present invention, it is possible to obtain satisfactory corrosion resistance and paintability.

Mn may be used in place of Ni, as described above, and the same effects and advantages can be obtained also by simultaneously using Ni and Mn.

Preferred Embodiments

Examples of the present invention will be described hereinbelow.

An electrogalvanized steel sheet having a coating weight of 30 g/m$^2$ (per one side) was employed in all of the following examples.

SAMPLE PREPARATION

EXAMPLES 1 to 8

Galvanized steel sheets were subjected to a pretreatment using a commercially available titanium colloidal treatment agent (PL—Zn made by Nihon Perkerizing Co., Ltd.) and then to a primary phosphate treatment by spraying a phosphate treatment bath shown in Table 1. Phosphate films having a weight as solid ranging from 0.2 to 1.7 g/m$^2$ varying according to the respective examples were formed at a temperature varying from 60 to 70° C. for a spraying time varying from 1.5 to 10 seconds. After the treatment, the thus treated sheets were once water-rinsed, dried, and further coated with an aqueous solution of magnesium biphosphate (aqueous solution of 50% magnesium biphosphate made by Yoneyama Chemical Industry Co., Ltd. diluted to five times) by roll-coating. The coated sheets were dried so as to achieve a final sheet temperature of 110° C. The coated film dry weights were adjusted to 0.3 to 1.5 g/m$^2$ by varying the number of rotation of the coater.

TABLE 1

Composition of Phosphate Treatment Bath (1)

| | Concentration |
|---|---|
| Phosphate ion | 10 g/l |
| Zn ion | 2 g/l |
| Ni ion | 4 g/l |
| Mg ion | 1 g/l |
| Nitrate ion | 10 g/l |
| F | 0.3 g/l |
| Total acid degree/free acid degree | 15 |

EXAMPLE 9

A phosphate film of 0.7 g/m$^2$ after drying was formed in the same way as in the preceding examples by the using the phosphate treatment bath shown in Table 1 under conditions of a spraying time of 2 seconds and a treatment bath temperature of 60° C. After water rinsing and drying, an aqueous phosphate solution containing a solid concentration of 10% prepared herein below was further coated on the phosphate treated steel sheet with a roll coater to have a total coated film weight of 1 g/m$^2$ and the thus coated sheet was dried so as to reach a carry-over sheet temperature of The aqueous solution was prepared by mixing a magnesium biphosphate aqueous solution (50% aqueous solution of magnesium biphospate made by Yoneyama Chemical Industry Co., Ltd.) with a manganese biphosphate (made by Yoneyama Chemical Industry Co., Ltd.; manganese phosphate dihydrogen 4 hydrate) and diluting the mixed solution so as to achieve a solid weight ratio of 2:1.

EXAMPLE 10

In the phosphate treatment bath shown in Table 1, Mn ion in an amount of 4 g/l was added in place of Ni ion, and a phosphate film of 1 g/m$^2$ was formed under conditions of a spraying time of 2 seconds and a treatment bath temperature of 65° C. After water rinsing and drying, an aqueous of magnesium biphosphate (50% aqueous solution of magnesium biphosphate solution made by Yoneyama Chemical Industry Co., Ltd.; diluted to five times) was coated with a roll coater, and the coated film was dried to reach a final sheet temperature of 110° C. so as to obtain 0.7 g/m$^2$ of the coated film in the solid form.

EXAMPLE 11

A phosphate treatment was conducted with a phosphate treatment bath shown in Table 2 by spraying. A phosphate film of 1.0 g/m$^2$ after drying was formed under conditions of a spraying time of 1.5 seconds and a treatment bath temperature of 60° C. After water rinsing and drying, a solution having a solid concentration of 10%, prepared by mixing an aqueous solution of manganese biphosphate (manganese phosphate dihydrogen tetrahydrate made by Yoneyama Chemical Industry Co., Ltd.) with an aqueous solution of magnesium biphosphate (50% magnesium biphosphate solution made by Yoneyama Chemical Industry Co., Ltd.) and diluting the mixed solution with water, to achieve a solid weight ratio of 2:1, was further coated on the phosphate treated sheet with a roll coater and the thus coated sheet was dried so as to reach a final sheet temperature of 110° C. to obtain a total solid weight of 1 g/m$^2$ of the coated film.

TABLE 2

Composition of Phosphate Treatment Bath (2)

| | Concentration |
|---|---|
| Phosphate ion | 10 g/l |
| Zn ion | 2 g/l |
| Ni ion | 0.2 g/l |
| Nitrate ion | 10 g/l |
| F | 0.2 g/l |
| Total acid degree/free acid degree | 15 |

EXAMPLES 12 and 13

A phosphate treatment was carried out by spraying on the steel sheet the phosphate treatment bath shown in Table 3. Phosphate films of 1.4 g/m$^2$ Example 12 and 0.6 g/m$^2$ (Example 13) respectively were prepared under conditions of a respective treating time of 4 seconds and 2 seconds and a treatment bath temperature of 70° C.

TABLE 3

Composition of Phosphate Treatment Bath (3)

| | Concentration |
|---|---|
| Phosphate ion | 6 g/l |
| Zn ion | 1 g/l |
| Ni ion | 4 g/l |
| Mg ion | 30 g/l |
| Nitrate ion | 80 g/l |
| F | 0.3 g/l |
| Total acid degree/free acid degree | 15 |

EXAMPLE 14

After carrying out the same treatments as in Example 13, an aqueous solution of magnesium biphosphate (50% aqueous solution of magnesium biphosphate made by Yoneyama Chemical Industry Co., Ltd.; diluted to five times) was coated with a roll coater, and dried to reach a final sheet temperature of 110° C. so as to obtain a solid weight of 1 g/m$^2$ of the coated film.

EXAMPLE 15

A phosphate treatment was applied by spraying the phosphate treatment bath shown in Table 3. A phosphate film of 0.4 g/m$^2$ was formed under conditions of a spraying time of 2 seconds and a treatment bath temperature of 65° C. After the treatment, the treated film was water-rinsed and dried.

EXAMPLE 16

A phosphate treatment was applied by spraying the phosphate treatment bath shown in Table 3. A phosphate film of 0.2 g/m$^2$ after drying was formed under conditions of a spraying time of 1.5 seconds and a treatment bath temperature of 60° C. After water rinsing and drying, the sheet was further coated with an aqueous solution of magnesium biphosphate and manganese biphosphate mixed together, having their solid weight ratio of 1:1 and dried so as to reach a final sheet temperature of 110° C. and a solid weight of 0.1 g/m$^2$of the coated film.

COMPARATIVE EXAMPLE 1

A phosphate treatment was applied by spraying the treatment bath having the same composition as in Table 3 except that Ni ion concentration is zero. A phosphate film of 1.5 g/m$^2$ was formed under conditions of a spraying time of 6 seconds and a treatment bath temperature of 65° C. After the treatment, the sheet was water-rinsed and dried.

COMPARATIVE EXAMPLE 2

A phosphate film of 0.1 g/m2 was formed under conditions of a spraying time of 0.5 seconds and a bath temperature of 55° C. using the treatment bath shown in Table 1. After water-rinsing and drying, an aqueous solution of magnesium biphosphate (50% aqueous solution of magnesium biphosphate made by Yoneyama Chemical Industry Co., Ltd.; diluted to ten times) was coated with a roll coater, and dried so as to obtain a final sheet temperature of 110° C. and a coated film weight after drying of 0.1 g/m$^{2.}$

COMPARATIVE EXAMPLE 3

A phosphate film was formed in the same manner as in Example 5 except that the aqueous solution of magnesium biphosphate was not coated after the phosphate treatment.

COMPARATIVE EXAMPLE 4

A phosphate treatment was applied by spraying the phosphate treatment bath shown in Table 4. A phosphate film of 1.5 g/m$^2$ after drying was formed under conditions of a spraying time of 4 seconds and a treatment bath temperature of 70° C. After the treatment, the film was rinsed with water and dried.

TABLE 4

Composition of Phosphate Treatment Bath (4)

| | Concentration |
|---|---|
| Phosphate ion | 15 g/l |
| Zn ion | 1 g/l |
| Ni ion | 3.5 g/l |
| Mg ion | 2 g/l |
| Nitrate ion | 18 g/l |
| F | 1 g/l |
| Total acid degree/free acid degree | 30 |

COMPARATIVE EXAMPLE 5

A phosphate treatment was applied by spraying the phosphate treatment bath shown in Table 5. A phosphate film of 1.5 g/m$^2$ after drying was formed under conditions of a spraying time of 4 seconds and a treating bath temperature of 65° C. Then, the formed film was water-rinsed and dried.

TABLE 5

| Composition of Phosphate Treatment Bath (5) | Concentration |
|---|---|
| Phosphate ion | 15 g/l |
| Zn ion | 1 g/l |
| Ni ion | 3.5 g/l |
| Mg ion | 8 g/l |
| Mn ion | 2 g/l |
| Nitrate ion | 28 g/l |
| F | 1 g/l |
| Total acid degree/free acid degree | 30 |

PERFORMANCE EVALUATING METHOD

Film weight: The phosphate film was totally stripped off by immersing the sample in a mixed aqueous solution stripping solution of 20 g/l of ammonium bichromate and 490 g/l of 25% ammonia. The film weight was calculated from the sample weight difference before and after stripping.

Film components (Mg, Ni, Mn): After heating the stripping solution containing the film with addition of nitric acid, quantities of Mg, Ni and Mn were determined with an ICP, and their weight percentages relative to the total film weight were calculated.

Paint Coating Adhesion (primary): Alkali degreasing (using SD280MZ made by Nihon Paint Co.), chemical treatment (using SD2500MZL made by Nihon Paint Co.) and cationic electrodeposition (using V-20 made by Nihon Paint Co., having a thickness of 20 $\mu$m) were applied to the sample. After holding the sample in this state for one day, scratches reaching the substrate were cut in checkers (100 squares) at intervals of 2 mm by means of an NT cutter, and after extruding the sample by 7 mm with an Erichsen tester, the film was stripped off with a cellophane tape. (Evaluation: xx: 100 squares stripped off; x: 99 to 6 squares stripped off; Δ: 1 to 5 squares stripped off: ○: no stripping, but stripping observed around cut scratches; ◎: perfectly no stripping).

Paint Coating Adhesion (secondary): After carrying out the same treatments as above up to the electrodeposition, the sample was immersed in a hot water at 50° C. for ten days, and then, the same test as above was conducted.

Corrosion Resistance after Paint Coating: After carrying out the same treatments as in the above-mentioned evaluation of coating adhesion up to the electrodeposition, the sample was held for one day. Cross cuts reaching the substrate were made with an NT cutter, and a salt-spray test specified in JIS-Z-2371 was carried out for 20 days. The film on the sample was then stripped off with a cellophane tape, and evaluation was made from the maximum value of stripped film width (one side) from the cross-cut portion. (x: over 10 mm; Δ: 3 to 10 mm; ○: under 3 mm).

Bare Corrosion Resistance: After sealing the sample edge and back with a tape, the number of days before occurrence of 5% red rust was measured in a salt-spray test specified in JIS-Z-2371. (xx: within one day; x: within two days; Δ: 2 to 5 days; ○: 5 to 10 days; ◎: 10 days or over).

The results of evaluation are shown in Table 6. While satisfactory paintability and corrosion resistance were obtained in the examples of the invention, one or more properties were deteriorated in the comparative examples which are outside the scope of the invention.

TABLE 6

| | | Results of evaluation | | | | | | | | | |
|---|---|---|---|---|---|---|---|---|---|---|---|
| | | Film | Chemical composition of film | | | | | | | Corrosion | Bare |
| | | weight | Mg | Ni | Mn | Mi + Mn | Mg + Ni + Mn | Coating adhesion | | resistance | corrosion |
| | No. | g/m2 | % | % | % | % | % | Primary | Secondary | after coating | resistance |
| Example of invention | 1 | 0.5 | 6.4 | 1.2 | 0 | 1.2 | 7.6 | ◎ | ◎ | ○ | ○ |
| | 2 | 1 | 5.3 | 1.6 | 0 | 1.6 | 6.9 | ◎ | ◎ | ○ | ◎ |
| | 3 | 1.2 | 8.8 | 0.5 | 0 | 0.5 | 9.3 | ◎ | ◎ | ○ | ◎ |
| | 4 | 1.5 | 3.6 | 2.0 | 0 | 2.0 | 5.6 | ◎ | ◎ | ○ | ◎ |
| | 5 | 2.2 | 2.5 | 2.5 | 0 | 2.5 | 4.9 | ◎ | ◎ | ○ | ◎ |
| | 6 | 2.1 | 2.1 | 4.0 | 0 | 4.0 | 6.1 | ◎ | ◎ | ○ | ◎ |
| | 7 | 2.5 | 6.3 | 1.6 | 0 | 1.6 | 7.9 | ◎ | ◎ | ○ | ◎ |
| | 8 | 2.5 | 4.3 | 1.8 | 0 | 1.8 | 6.1 | ◎ | ◎ | ○ | ◎ |
| | 9 | 1.7 | 4.2 | 1.2 | 3.4 | 4.6 | 8.8 | ◎ | ◎ | ○ | ◎ |
| | 10 | 1.7 | 4.4 | 0.0 | 2.1 | 2.1 | 6.5 | ◎ | ◎ | ○ | ◎ |
| | 11 | 2 | 3.5 | 0.1 | 2.9 | 2.9 | 6.4 | ◎ | ◎ | ○ | ◎ |
| | 12 | 1.4 | 3.0 | 1.4 | 0 | 1.4 | 4.4 | ◎ | ◎ | ○ | ○ |
| | 13 | 0.6 | 2.9 | 2.7 | 0 | 2.7 | 5.6 | ◎ | ◎ | ○ | ○ |
| | 14 | 1.6 | 7.7 | 1.0 | 0 | 1.0 | 8.7 | ◎ | ◎ | ○ | ◎ |
| Comparative example | 1 | 1.5 | 4.0 | 0.0 | 0 | 0.0 | 4.0 | Δ | x | x | ○ |
| | 2 | 0.2 | 5.4 | 2.0 | 0 | 2.0 | 7.4 | ○ | ○ | Δ | Δ |
| | 3 | 1.2 | 0.3 | 5.0 | 0 | 5.0 | 5.3 | ◎ | ◎ | ○ | x |
| | 4 | 1.5 | 0.0 | 2.5 | 2 | 4.5 | 4.5 | ◎ | ◎ | Δ | xx |
| | 5 | 1.5 | 1.0 | 2.0 | 2 | 4.0 | 5.0 | ◎ | ◎ | ○ | Δ |
| Example of invention | 15 | 0.4 | 4.5 | 0.8 | 0 | 0.8 | 5.3 | ◎ | ◎ | ○ | ○ |
| | 16 | 0.3 | 2.9 | 0.3 | 2.5 | 2.8 | 5.7 | ◎ | ◎ | ○ | ○ |

EFFECTS OF INVENTION

According to the present invention, it is possible to obtain a phosphate treated galvanized steel sheet having excellent corrosion resistance and paintability which were not obtained conventionally. The phosphate treated steel sheet according to the present invention does not use harmful substances such as hexavalent chromium and can be produced easily and advantageously from the point of production cost and is suited for use in various applications such as automobile, home electric appliances and building materials.

What is claimed is:

1. A phosphate-treated galvanized steel sheet excellent in corrosion resistance and paintability, comprising a phosphate film in an amount of at least 0.5 $g/m^2$, containing at least 2 wt. % of Mg, and at least 0.5 wt. % in total of Ni and/or Mn, with Mg and Ni and/or Mn being in a total amount of at least 4 wt. %, formed on a zinc or zinc alloy plated steel sheet.

2. A phosphate-treated galvanized steel sheet excellent in corrosion resistance and paintability, comprising a phosphate film in an amount of at least 1 $g/m^2$, containing at least 2 wt. % of Mg, and at least 0.5 wt. % in total of Ni and/or Mn, with Mg and Ni and/or Mn being in a total amount of at least 5 wt. %, formed on a zinc or zinc alloy plated steel sheet.

* * * * *